US007108301B2

(12) United States Patent
Louvel

(10) Patent No.: US 7,108,301 B2
(45) Date of Patent: Sep. 19, 2006

(54) DOOR HANDLE EQUIPPED WITH AN AUTOMATIC RETRACTABLE FLAP

(75) Inventor: Philippe Louvel, Le Plessis-Robinson (FR)

(73) Assignee: Huf Hulsbeck & Furst GmbH & Co. KG, Velbert (DE)

( * ) Notice: Subject to any disclaimer, the term of this patent is extended or adjusted under 35 U.S.C. 154(b) by 40 days.

(21) Appl. No.: 10/482,385

(22) PCT Filed: Jun. 11, 2002

(86) PCT No.: PCT/FR02/01982

§ 371 (c)(1),
(2), (4) Date: Jan. 30, 2004

(87) PCT Pub. No.: WO03/004809

PCT Pub. Date: Jan. 16, 2003

(65) Prior Publication Data

US 2004/0177478 A1 Sep. 16, 2004

(30) Foreign Application Priority Data

Jul. 5, 2001 (FR) ..... 01 08923

(51) Int. Cl.
*E05B 3/00* (2006.01)

(52) U.S. Cl. ..... 292/336.3; 292/201; 292/DIG. 37; 70/277; 70/278.1

(58) Field of Classification Search ..... 292/336.3, 292/201, 216, DIG. 37; 200/50.1; 70/255, 70/257, 278.1, 277
See application file for complete search history.

(56) References Cited

U.S. PATENT DOCUMENTS 2,237,949 A * 4/1941 Palmer ..... 292/165
4,778,206 A * 10/1988 Matsumoto et al. ..... 292/201
5,560,659 A * 10/1996 Dault ..... 292/336.3
5,613,716 A * 3/1997 Cafferty ..... 292/216
5,682,135 A * 10/1997 Labonde ..... 340/426.17
5,844,470 A 12/1998 Garnault et al.
5,880,538 A 3/1999 Schulz
5,901,991 A * 5/1999 Hugel et al. ..... 292/201
6,062,614 A * 5/2000 Petzold ..... 292/336.3
6,072,403 A * 6/2000 Iwasaki et al. ..... 340/5.72
6,416,092 B1 * 7/2002 Rathmann ..... 292/336.3
6,429,782 B1 8/2002 Pavatich et al.
6,588,813 B1 * 7/2003 Marcarini et al. ..... 292/347
2002/0011920 A1 1/2002 Mindl et al.

FOREIGN PATENT DOCUMENTS

DE 37 00 135 A1 7/1988
DE 38 35 265 A 4/1990

(Continued)

*Primary Examiner*—Brian E. Glessner
*Assistant Examiner*—Carlos Lugo
(74) *Attorney, Agent, or Firm*—Sughrue Mion, PLLC

(57) ABSTRACT

A door handle for the side door, rear door or trunk of a motor vehicle, the door handle being fitted with a flap (1) that retracts automatically when the handle is used. The flap is fitted with a sensor (5) that detects the presence of a handle opposite the flap. When the flap is not in use, it is closed in such a way as to be flush with the external surface (2) of the door and it is held in position by a spring recall system. A computer-controlled actuation device is designed to retract the flap at the appropriate moment in order to provide access to the door opening control (8). The flap systems can be connected to an electric or mechanical opening control.

10 Claims, 7 Drawing Sheets

FOREIGN PATENT DOCUMENTS

| | | | |
|---|---|---|---|
| DE | 198 47 212 | A1 | 4/2000 |
| EP | 0 198 766 | B1 | 10/1986 |
| EP | 0 398 106 | A | 11/1990 |
| EP | 0 954 098 | A | 11/1999 |
| FR | EP 1099810 | * | 5/2001 |
| GB | 576 224 | A | 3/1946 |
| WO | WO 00 43621 | A | 7/2000 |

* cited by examiner

DOOR HANDLE EQUIPPED WITH AN AUTOMATIC RETRACTABLE FLAP

BACKGROUND OF THE INVENTION

The present invention relates to an external door handle of a motor vehicle. The style of modern cars has become a prominent factor of appeal and market success, this invention discloses a vehicle external handle which is at the same time very practical and very convenient and also enables to achieve new possibilities for the vehicle style, especially the lateral style.

PRIOR ART

Patent EP0198766, issued in 1986, is known, and discloses a vehicle external handle. The goal of this invention is to conceal any recess in the area of the handle. The target is to have the appearance of an overall flush surface in this area.

The drawback of this invention is twofold:

the angular range to activate the handle is greater than 90 degrees, which results in poor ergonomics, the area of handling is most of the time dirty because this area, as the whole external body, is directly exposed to rain and various projections.

One knows patent DE3700135, published in 1988, which discloses a vehicle external handle. When the vehicle is at standstill or at a very low speed, the external handles are protruding; above a given vehicle speed, the handles retract to give an overall flat external surface in the area of the handle.

The drawback of this invention is that, when the vehicle is at standstill, the style and the appearance of the handle area is poor.

One knows patent DE19847212, published in 2000, which unveils a vehicle external handle. In this invention, a movable flap is able to close the access to the handle. This movable flap closes as the vehicle moves or if the doors are locked. However, when the vehicle is at standstill and the doors are not locked, the flap remains open, which is poor. Moreover, the system arrangement is downwards oriented, consequently it is prone to get dirty in connection with water drip.

One also knows the Alfa Romeo 156 vehicle, recently launched on the market. On this vehicle, the rear external handle is hidden in the dark area above the door outer skin above the outside sheet plate of the door. This enables to have a very pure lateral style, but the ergonomics of this kind of handle is rather poor, especially for children or small persons.

BRIEF DESCRIPTION OF THE INVENTION

The invention disclosed hereafter solves the drawbacks of the prior art inventions and unveils a vehicle external handle with a particularly good looking style and which is very easy to use.

The purpose of the invention is to present an external door handle for a motor vehicle, for lateral door or trunk lid or tailgate, said door handle is fitted with a movable flap that retracts automatically when the handle is operated. This flap is fitted with a sensor that detects the presence of the hand in front of the handle.

When the flap is at rest, it is closed. The flap is kept in this position by a return spring arrangement. The system that retracts the flap can be, as a non limitative example, a system with a small electrical motor, a pulley and a flexible cable which winds up around the pulley. The other end of the cable is fastened to the flap bracket. Another implementation used for the retraction movement will be described further in another preferred embodiment of the invention.

This flap system can be combined with either an electrical-type latch control or with a mechanical-type latch control. In the case of an electrical-type door latch control, the fingers of the user operate on an electrical switch, and the electronic control unit then controls an electrical type latch of known type. In the case of an mechanical-type door latch control, the fingers operate on a mechanical lever which interacts with a mechanical cable, said cable interacts with a known mechanical latch.

In the normal cases of use, the hand of the user does not touch the flap, but only touches the opening control, which is not affected by dirt, according to its position, even in the case of adverse weather conditions.

Functional Principle

When the hand of the user gets close to the flap, the sensor detects the presence of this hand and sends this information to the electronic control unit. According to current conditions, several processes can occur: the doors are already unlocked (case A/), the doors are locked and there is no authorization to unlock (case B/) or the doors are locked and the authorization to unlock is granted (case C/).

The authorization to unlock is given by an electronic identifier carried by the user.

A/ Doors Unlocked

If the doors are unlocked, as soon as the sensor detects the presence of a hand, then the control unit triggers the folding of the flap by activating the electric motor geared to the pulley, a soft cable winding around said pulley. The traction on this cable pulls the flap towards the inner side of the handle area. This gives free access to the fingers of the user in order to operate the opening control itself.

When the sensor does not detect any hand anymore and if the opening control is not actuated anymore, then the control unit controls the folding motor in the opposite direction and the flap unfolds back.

B/ Doors Locked (and Unlocking Authorization Not Present)

If, when the hand is detected, the vehicle is locked, then the detection triggers an attempt to authenticate the identifier carried by the user.

If, after the sensor has detected a hand, no identifier is recognized, then the control unit does nothing and, in particular, does not control the folding of the flap. The hand can push the flap, because the linkage between the flap and the motor is supple and allows a manual actuation. As soon as the hand goes back, the flap goes back to the rest position (closed). Even if the fingers activate the opening control, the control unit does not activate the unlatching and the latch remains locked.

C/ Doors Locked and Unlocking Authorization Present (Hand Free Unlocking)

If, after a hand detection, an identifier and the exchange of codes is satisfactory, then the control unit activates the folding of the flap. In the case of the mechanical-type latch, the control unit activates as well the unlocking of the latch to authorize the opening of the door. When the fingers operate the opening control, the door is unlocked and the door opens. When the sensor of the flap does not detect any hand anymore and the opening control is not actuated anymore, then the control unit controls the folding motor in the opposite direction and the flap unfolds back.

The functional logic will be detailed later.

BRIEF DESCRIPTION OF THE DRAWINGS

FIG. 3 shows the stage when the hand is detected in front of the flap.

FIG. 4 shows the actuation of the opening control, the flap being folded.

FIG. 5 shows the situation when the flap is manually actuated, without any folding control of the flap.

FIG. 7 shows the chronogram in the case the doors are already unlocked (case A/).

FIG. 8 shows the chronogram in the case the doors are locked and no identifier is recognized (case B/).

FIG. 9 shows the chronogram in the case the doors are locked and an identifier is recognized (case C/).

FIG. 11 shows a side view of the system, in the rest position.

FIG. 12 shows a front view of the system, from the inner side of the door.

FIG. 13 shows a side view of the system, in the folded position.

FIG. 14 shows a side view of the system, in the case of a manual action on the flap.

FIG. 15 shows a 3D view of the vehicle door outer skin, viewed from the inside of the door.

FIG. 16 shows a 3D view of the housing (4).

FIG. 17 shows a 3D view of the flap (1) together with its bracket (12).

DETAILLED DESCRIPTION OF THE INVENTION

The functionalities and the characteristics of the invention will be explained in the following description which will follow.

Figure 2:
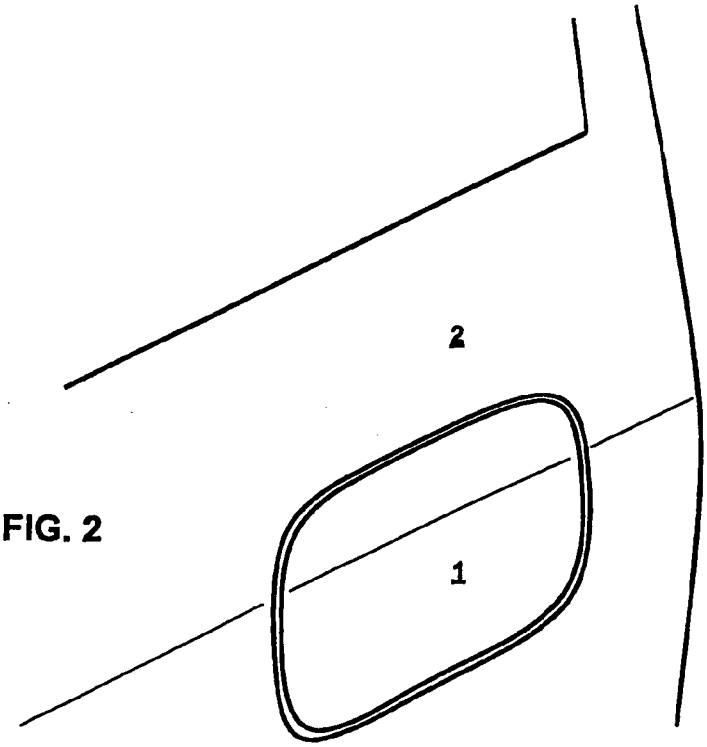
FIG. 2 shows the appearance of the outside handle at rest.

The main goal of the invention is to propose an automotive door handle system allowing a very good looking style, particularly for the lateral style. Actually, when the system is at rest, the door presents a uniform appearance and it shows no recess and no protrusion. The visible part of the handle is simply a flap 1 which is perfectly flush with the outer door skin 2. This is shown on drawing FIG. 2. The gap between the door outer skin and the flap is reduced thanks to the mechanical adjustment that will be explained further.

This kind of flap already exists for fuel lid cap on most of recent vehicles.

According to the invention, the flap 1 is made of plastic material, which is painted with the same color as the door outer skin.

The shape of the flap preferably follows the shape of the door outer skin, in order to have homogenous and enhanced light play on the whole door outer surface.

The perfect flush effect of the flap relative to the door outer skin is fulfilled by the means of a fastening system and stops which will be detailed later.

Figure 1:
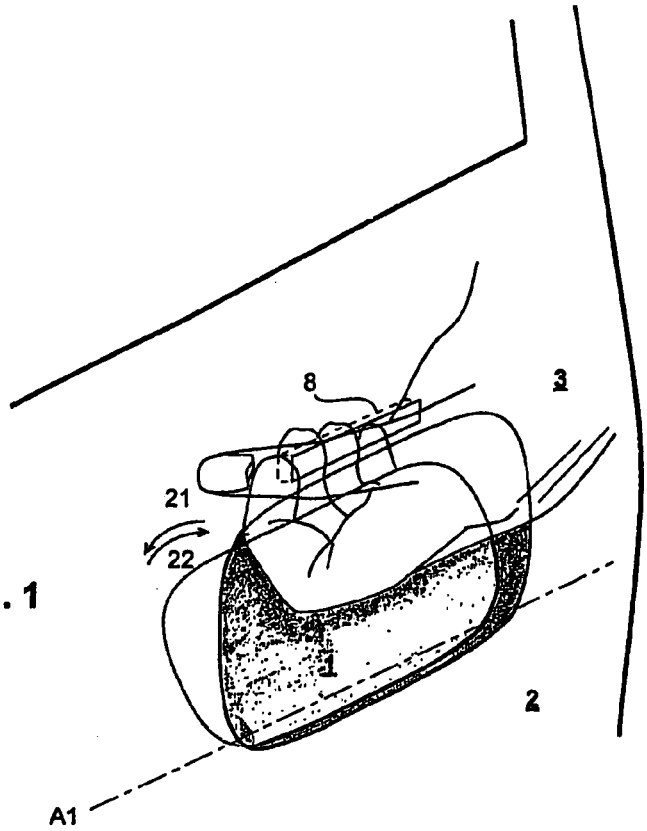
FIG. 1 shows the invention in use.

The flap automatically retracts (or "folds") when a hand 3 or any other object gets closer to the flap and is detected by the sensor, at a distance comprised between 1 and 2 cm. This is shown on FIG. 1.

The flap rotates around an axis A1, said axis being coaxial with the longitudinal axis of the vehicle. The axis is located is the bottom part of the flap. The folding of the flap consists in rotating the flap towards the direction 21.

The unfolding of the flap to the rest position consists in rotating the flap in the direction 22.

The folding of the flap allows the fingers of the user to reach easily the door opening control switch 8 which is located above the flap, behind the door outer skin.

Figure 3:
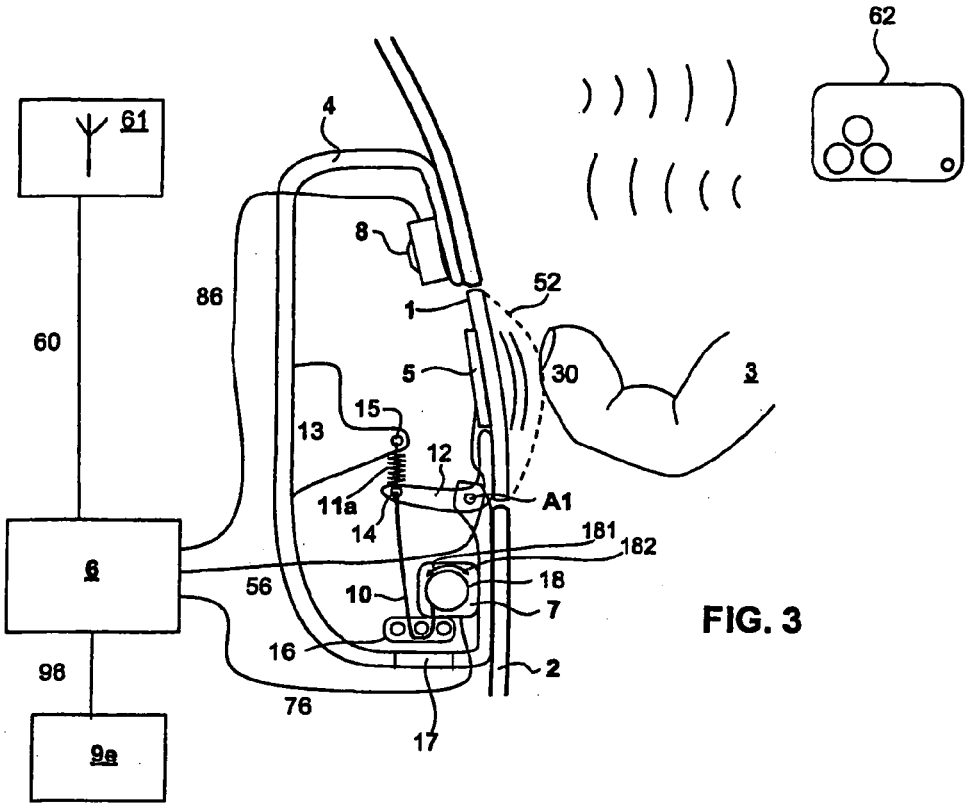
FIGS. 3 to 5 show the general arrangement and the general functionality of the invention.

The drawing FIG. 3 shows a cross sectional view of the whole handle system, fitted with the automatic flap.

The flap 1 is shown in the rest position. Its surface is perfectly flush with door outer skin surface 2. The whole system is supported by a housing 4 which is waterproof in its upper part and open in its lower part 17. The housing 4 is fastened on the door outer skin 2. A presence (or "proximity") sensor 5 is located behind the flap: the purpose of this sensor is to detect the presence of any object opposite of said flap.

This sensor may be an optical or an ultrasonic sensor. In both cases, in order to guarantee its effectiveness, the sensor must be located directly at the surface of the flap, and is likely to be visible.

Thus, in the preferred embodiment of the invention, the sensor is of capacitive type, which is well known: this enables to have a sensor which is entirely hidden behind the flap and a uniform visual aspect of the outside of the flap.

This sensor is located just behind the flap and its action range is depicted by the area 52. The flap is painted according to the body color. The paint of modern vehicles are commonly metallic paint. As the metallic paint is slightly conductive, the action range of the sensor is enlarged to all the surface of the flap 52. Actually the capacitance variation occurs whenever an object gets closer to the flap, in any area of the flap.

The flap 1 is fastened to the flap bracket 12. The flap bracket rotates along the axis A1, with respect to the housing 4. This bracket has a general L-shape. At one end 14 the traction cable 10 is fastened, said cable being the means used for the folding motion. This cable 10 goes through a guidance arrangement 16 and winds up around the pulley 18. This pulley is coupled to a small electric motor 7 which can rotates in one direction or in the other according to the controls given by the control unit 6.

On the end 14 of the flap bracket is also fastened the bottom part of the spring 11*a*. The upper part of the spring 11*a* is secured in a hole made on the part 13 which is integral with on the housing 4.

Above the flap, in the upper area of the housing 4, the door unlatch switch 8 is located. In the electrical-type latch version, this unlatch switch is a simple broad electrical switch that can be actuated by the fingers of the vehicle user, as shown in FIG. 3.

The hand 3 of the user is shown in the position when the sensor is bound to detect its presence, because the outer part of the finger 30 enters in the action range area of the sensor.

On the drawing FIG. 3 is also depicted a part of the electrical control system. The control unit 6 includes the control means and all the relevant logic processing. The control unit 6 is connected to the sensor by the link 56. The control unit 6 is also connected to the door unlatch switch 8 through the link 86. The control unit 6 controls the folding motor 7 via the link 76 by the means of a well-known double relay control circuit.

The control unit 6 is also connected via the link 60 to an antenna system 61, said antenna system is used to communicate with the user identifier 62.

Finally, the control unit 6 controls the door latch 9*e*, which is state of the art, via the link 96.

Figure 4:
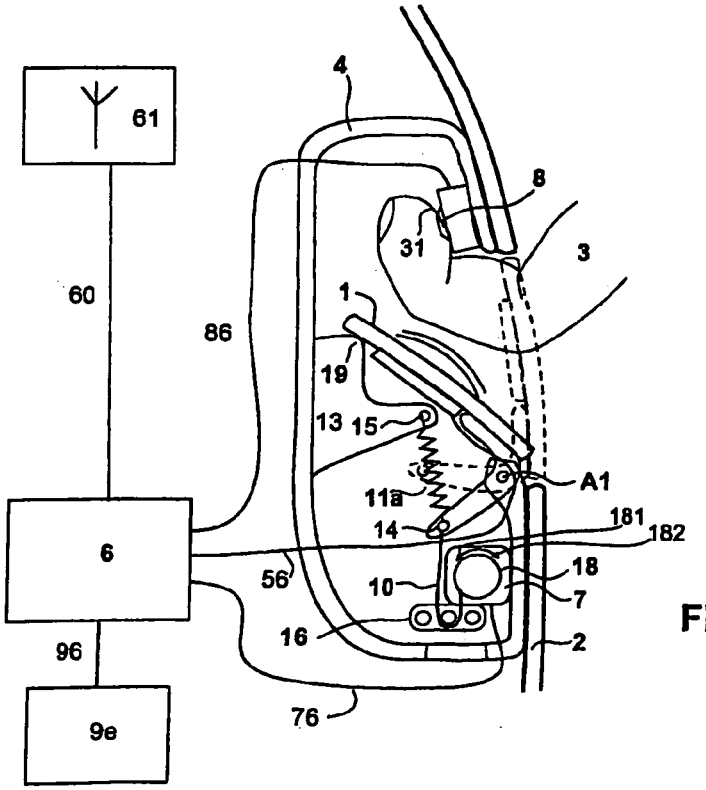

The drawing FIG. 4 shows the system when the flap is in the folded position. The flap 1 is held against the stop in the area 19 of the part 13. The return spring 11 is elongated and applies a return force. The cable 10 applies a traction force on the bracket 12, the motor and the pulley having winded up the loose part of the cable.

The inner part of the finger 31 of the user actuates the door unlatch switch 8.

Figure 5:
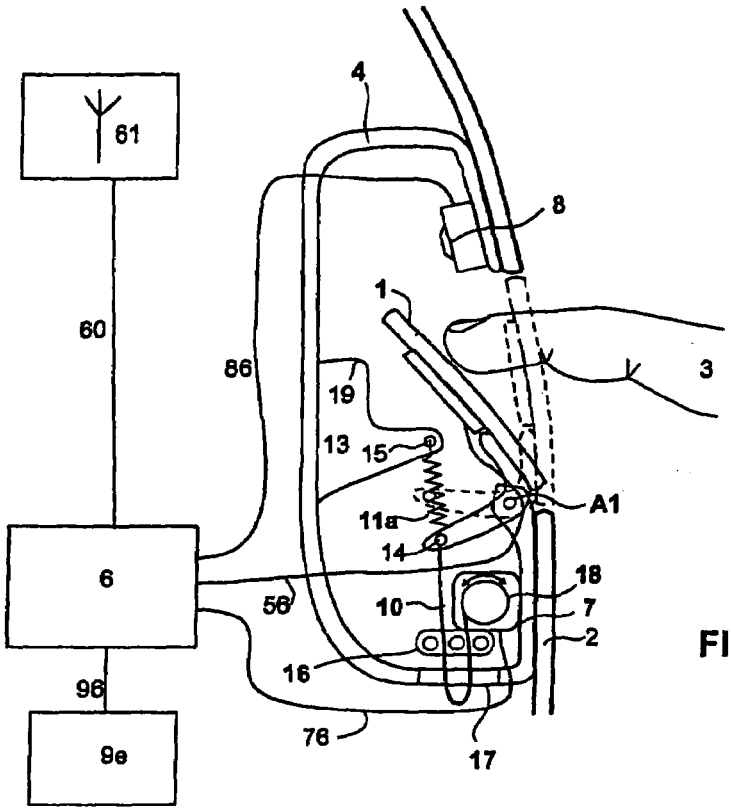

The drawing FIG. 5 shows a manual actuation on the flap, without any controlled folding. In this case, the cable extends and elongates beneath the guidance arrangement 16. Thank to this guidance arrangement the cable cannot away from the pulley groove 18.

Figure 6:
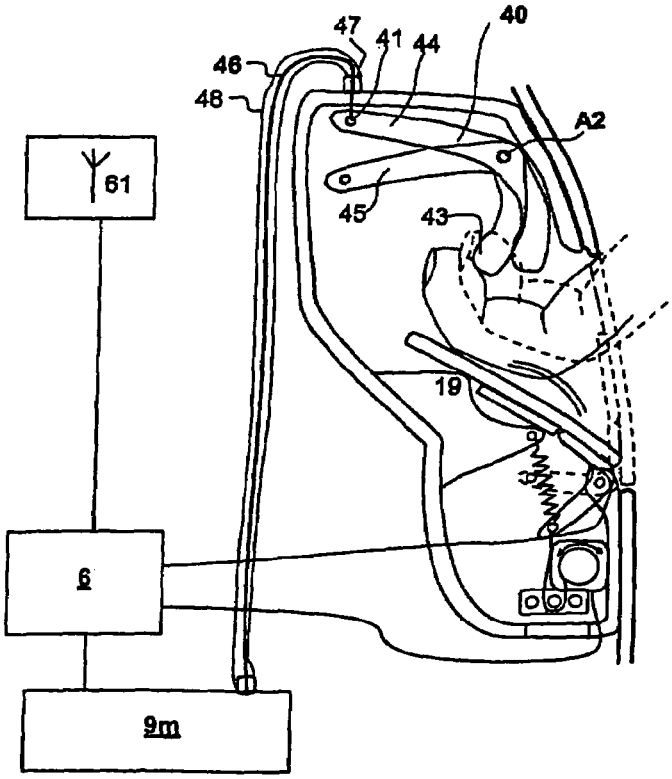
FIG. 6 shows the invention with a mechanical-type door latch.

The drawing FIG. 6 shows the system with a mechanical-type door latch control.

In this configuration, the size of the flap and the size of the upper area of the main housing 4 are larger.

In this configuration, the fingers of the user do not actuate anymore a switch, but a mechanical lever 40 that rotates along the axis A2. The fingers apply a force on the area 43 of the lever 40.

At the other end of the lever 41, the control cable 46 of the state-of-the-art mechanical latch 9*m* is fastened. When the user actuates the lever, he pulls the lever towards the position 45. The door latch mechanical control cable 46 slides in a well-known protection sheath 48. The elastic return force is performed by a spring located into the door latch. This spring loaded return force drives back the lever 40 to the rest position 44 as soon as the user stops actuating the lever.

The functional principle of the flap is the same as in the electrical type door latch version.

Detailled Functional Logic and Control Process

Figure 7:
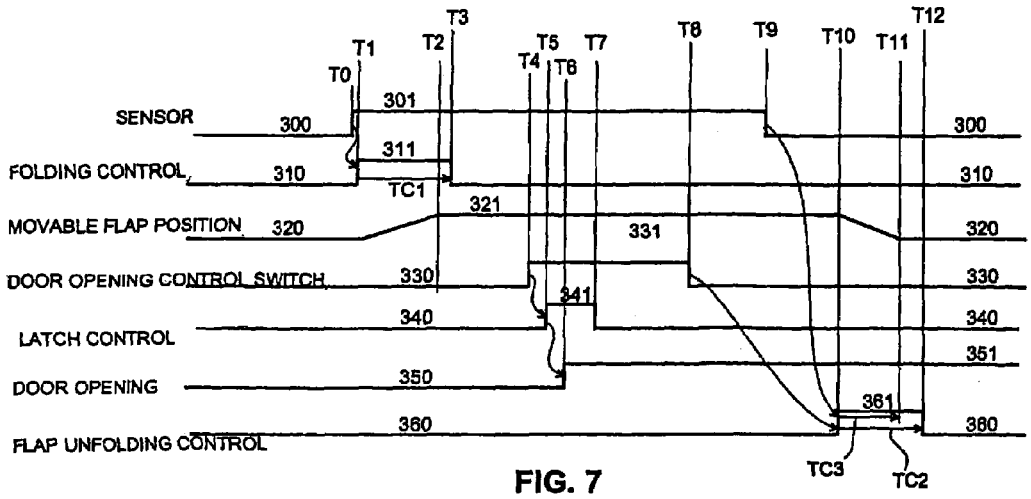
FIGS. 7 to 9 show the principle of the invention in the form of chronograms.

The drawing FIG. 7 shows the operational chronogram when the door handle is used if the vehicle doors are already unlocked (case A).

At the beginning, the system is at rest, the sensor output is not active (state 300). At the time T0, the hand getting closer to the flap, the sensor detects its presence and switches its output to the active state 301. The control unit 6 receives this information via the link 56. As the doors of the vehicle have already been unlocked before, the control unit immediately activates the folding of the flap at the time T1. The control output change from state 310 to state 311 and the motor 7 rotates in the direction 181. Consequently, the position of the flap evolves from the position 320 to the position 321. The extreme position in full stop is reached at the time T2. After a predefined control time of TC1, at the time T3, the control unit stops the motor folding activation.

Then, the fingers of the user's hand enter the recess made free by the folding of the flap, and then actuates the control switch 8 at the time T4. The state of the switch changes from inactive 330 to active 331. The control unit 6 receives this information and actuates immediately the motor of the latch 9*e* at the time T5. The door latch output changes from state 340 state 341. Just after, at the time T6, the door is unlatched from the door latch striker and the door is opened (change from state 350 to state 351). The control unit then stops the unlatch motor control at the time T7.

Later, when the user stops activating the control switch 8 at the time T8, the switch output changes from state 331 to state 330. Later on, when the user removes his hand from the handle, the output of the sensor 5 change from state "active" 301 to state "inactive" 300, at the time T9.

The control unit continuously monitors the information given by the sensor 5 and by the control switch 8: when they have been both at the inactive state from some hundreds of milliseconds, the control unit performs the return cycle of the flap to the rest position ("unfolding" cycle). At the time T10, the folding motor output changes from state 360 to state 361, and consequently, the motor 7 rotates in the direction 182. The position of the flap evolves from state 321 to state 320. The flap reaches the rest position at the time T11, after a time TC3 from the beginning of the control period. After a control period of TC2, the control unit stops the motor return control, at the time T12. The period TC2 is determined to be greater than time TC3 to ensure a complete return on the stops of the rest position. But the period TC2 is determined not to exceed too much the time TC3 to avoid unnecessary unwinding of the cable 10, which would enlarge the reaction time at the next folding cycle.

Figure 8:
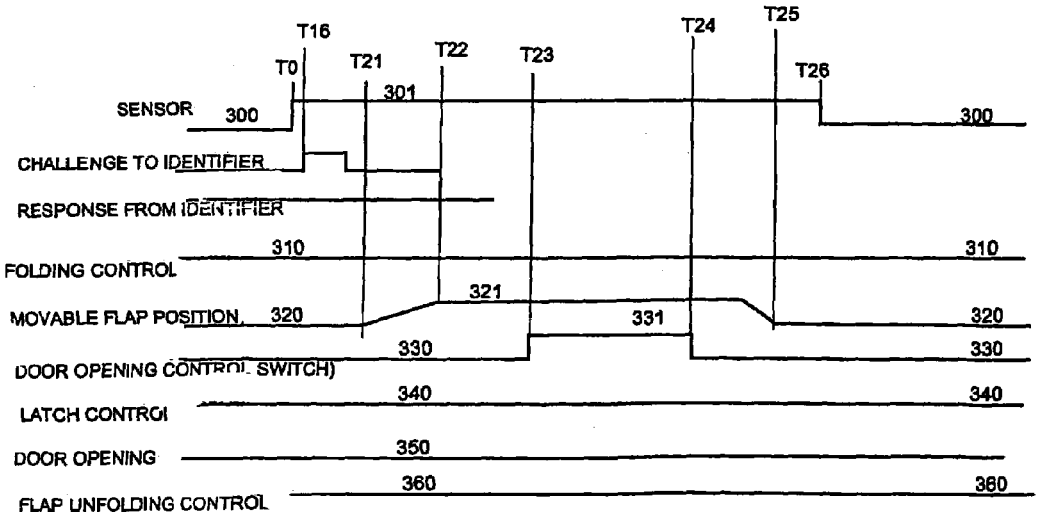

The drawing FIG. 8 shows the operational chronogram when the door handle is used if the vehicle doors are locked and if there is no authorization to unlock (case B/).

At the beginning, the sensor output is not active (state 300). At the time T0, the hand getting closer to the flap, the sensor detects its presence and switches its output to the active state 301. The control unit receives this information via the link 56. The doors of the vehicle being locked, the control unit triggers an authentication of the user identifier, this is done at time T16. As the authentication fails (identifier not present or wrong identifier), the control unit does not activate the folding control and the motor drive output remains at inactive state 310.

Meanwhile, under the action of the hand of the user, the flap is pushed from the position 320 to the position 321, between time T21 and time T22.

Afterwards, the fingers of the user enter the inner handle area and then activate the control switch 8 at the time T23. The switch output changes from state 330 to state 331. The control unit 6 receives this information but does not actuate the unlatch motor 9*e*, the output remains at the inactive state 340.

The fingers stop to activate the control switch at the time T24.

At the time T25, the action of the fingers pushing the flap stops, and the flap returns to the rest position 320.

Later the sensor does not detect anymore the fingers, at the time T26, the system has gone back to complete rest situation.

Figure 9:
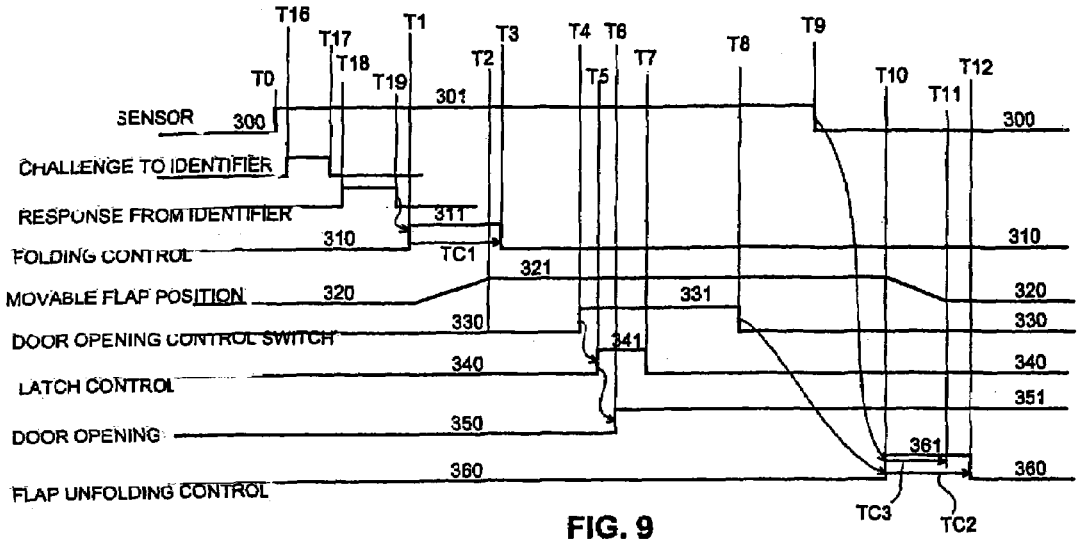

The drawing FIG. 9 shows the operational chronogram when the door handle is used if the vehicle doors are locked and if the authorization to unlock is valid (case C/).

At the beginning, the sensor output is not active (state 300). At the time T0, the hand getting closer to the flap, the sensor detects its presence and switches its output to the active state 301. The control unit receives this information via the link 56. The doors of the vehicle being locked, the control unit triggers an authentication of the user identifier, this process begins at time T16 and is completed successfully at time T17. The identifier answer occurs between time T18 and time T19. As the authentication result is satisfactory, the control unit 6 has the authorization to control the folding of the flap. The folding activation begins at time T1, the motor drive output changing from state 310 to state 311 and the motor 7 rotates in the direction 182. Consequently, the position of the flap evolves from the position 320 to the position 321. The extreme position in full stop is reached at the time T2. After a predefined control time of TC1, at the time T3, the control unit stops the motor folding activation.

Then, the fingers of the user's hand enter the area made free by the folding of the flap, and then actuates the control switch 8 at the time T4. The state of the switch change from inactive 330 to active 331. The control unit 6 receives this information and actuates immediately the motor of the latch 9*e* at the time T5. The door latch output changes from state 340 state 341. Just after, at the time T6, the door is unlatched from the door latch striker and the door is opened (change from state 350 to state 351). The control unit then stops the unlatch motor control at the time T7.

The subsequent steps of the chronogram are strictly identical to the chronogram of FIG. 7 which has been detailed above.

Figure 10:
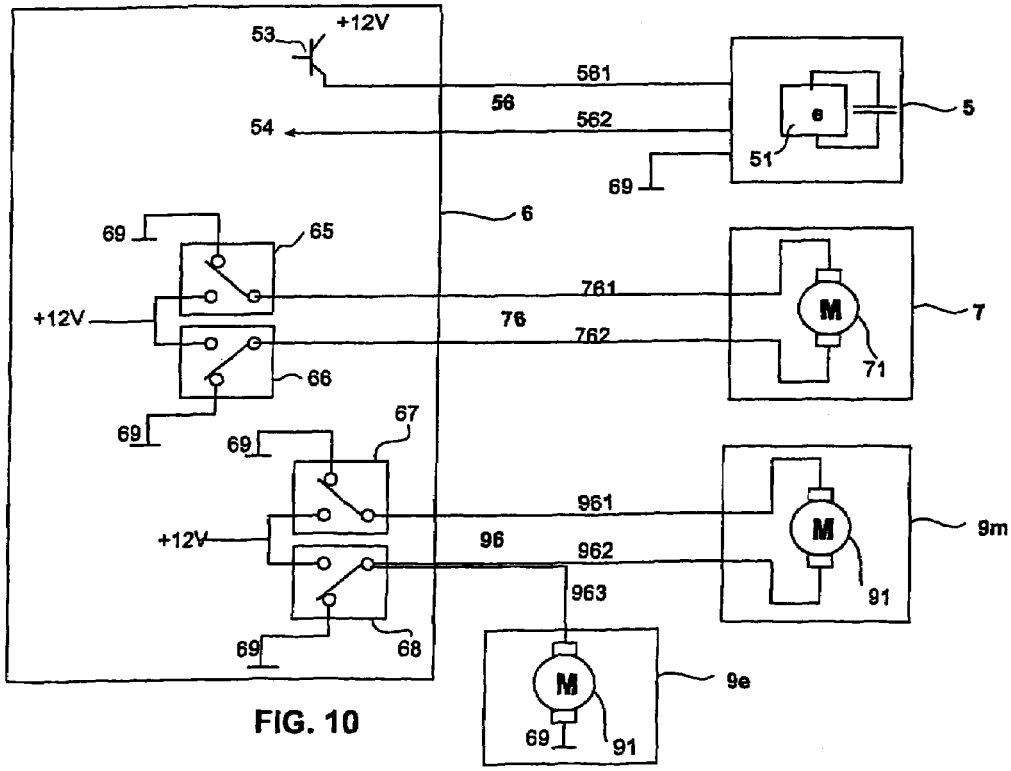
FIG. 10 shows the electrical circuit diagram of the handle and its connections.

The drawing FIG. 10 shows the electrical circuit diagram of the invention. The control unit 6 contains all the circuitry necessary to interface with the proximity sensor 5, the flap folding motor 7, the door latch motor which can be either of electrical type 9*e* or of mechanical type 9*m*. The sensor is supplied via a transistor 53 which switches the current required by the sensor internal electronics 51. In some special conditions, or after a certain time without any activity on the vehicle, the control unit 6 stops the power supply of the sensor by switching off the transistor 53. In this way, the sensor is not supplied anymore, and does not consume any current from the battery of the vehicle, which is better, particularly in the case when the vehicle is not used for a long period of time (for example more than one week). In this very particular case, the user will have to push himself the flap to gain access to the door control switch.

The sensor output signal goes through the wire 562 and is read as an input 54 by the control unit 6.

The positive power supply is carried by the wire 561. The power supply wire 561 and the output signal wire 562 constitute the link 56 between the control unit 6 and the sensor 5.

The motor 71 of the folding arrangement is controlled by the means of two relays according to a well-known electric circuit diagram. The relay 65 controls the motor in the folding direction. When this relay is energized, the wire 761 is set to positive supply voltage 12V and the other one 762 remains at ground potential. Thus, the motor is rotating in the direction 182. The opposite relay 66 controls the motor in the unfolding direction, that-is-to-say in the direction of the rest position. When this relay is energized, the wire 762 is set to positive supply voltage 12V while the other one 761 remains at ground potential. Thus, the motor is rotating in the direction 181.

The door latch may be of electrical type or of mechanical type. The electrical circuit diagrams differ slightly from one to another but they are both depicted in drawing FIG. 10.

In the case of electrical type door latch (more and more popular for trunks and tailgates), only the unlatch action is controlled by an electrical driven action. The latch of the door is made by simply closing the door. Actually, the door locked status is achieved by not granting authorization to unlatch.

The unlatch action is realized when the control unit energizes the relay 68. The wire 963 is set to the positive voltage 12V in order to free the latch from the latch striker.

In the case of widespread mechanical type door latch, the locking and unlocking processes are realized by an electrically controlled process, while the latch and unlatch processes are completely mechanical processes.

A very common double relay electric circuit diagram is used.

The relay 67 drives the door latch motor in the locking direction. When this relay is energized, the wire 961 is set to positive supply voltage 12V and the other one 962 remains at ground potential. Thus the motor rotates in the locking direction. The opposite relay 68 drives the door latch motor in the unlocking direction. When this relay is energized, the wire 962 is set to positive supply voltage 12V while the other one 961 remains at ground potential. Thus the motor rotates in the unlocking direction.

According to another feature of the invention, the flap folding/unfolding process is protected against overheat or overload that could be caused by too many actuations in a very short time. The control unit 6 includes a software feature which inhibits the folding process for a period of time if the system has been used just before too often in a short period of time.

Drawings FIG. 11 to FIG. 17 show a preferred embodiment of the invention, and depict details of the mechanical arrangement.

Figure 11:
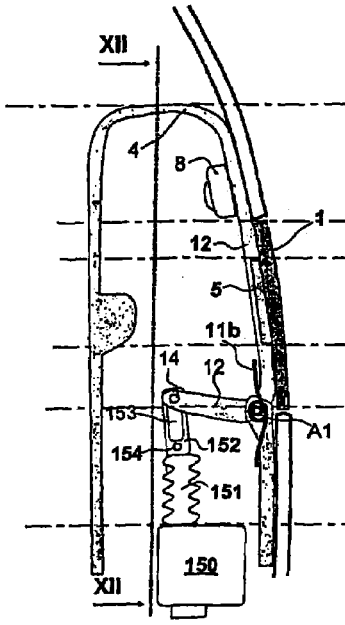
FIGS. 11 to 17 show a preferred embodiment of the invention, with all the mechanical details.
Figure 12:
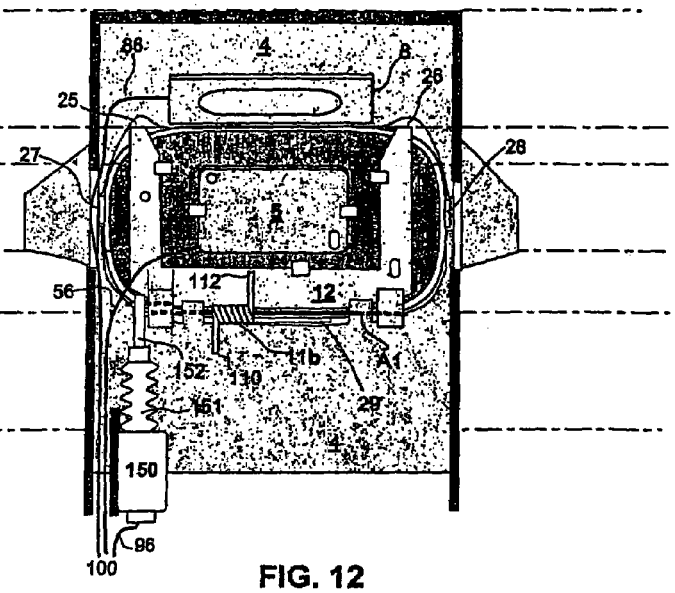

FIG. 11 shows a side view of the complete system, while FIG. 12 shows the corresponding front view, taken from the inner side. The flap 1 is at rest position ("closed"). The elastic return consists of a helical spring 11*b* which leans for one part on the housing 4 in the area 110 and leans for the other part on the bracket 12 in the area 112. The articulation axis A1 goes through the center of the spring and contributes to securing the spring 11*b* in its position. The folding arrangement is made of a commonly used actuator 150, which is linked to the flap bracket 12 by the means of a connecting rod 152, thanks to the articulation 154.

This kind of actuator is a well known component in the automotive industry, and is usually used to control the locking and unlocking of the door latches. The functionality of the actuator is very similar to the functionality that has been described above for the cable and pulley generic implementation.

Figure 13:
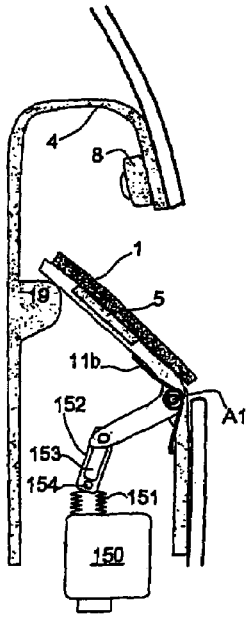

The actuator includes a small electric motor and a helical gear which transforms the rotating movement into a translation movement. This actuator is controlled in a binary mode: its normal positions are either completely projected (FIG. 11) or completely retracted (FIG. 13).

The translating rod going out the actuator is protected against environmental conditions by an extendible gusset joint 151.

On the drawings FIG. 11 and FIG. 12, the actuator is in the projected position, it does not exert any force on the flap bracket via the articulation 14.

On the drawing FIG. 12, the electrical wiring is shown. The link 86 goes from the door control switch 8 to the control unit 6 via the main door harness in the area 100. The link 56 goes from the sensor 5 also to the control unit 6 via the main door harness in the area 100. The link 96 goes from the actuator 150 to the control unit.

On the drawing FIG. 12, the mechanical interfaces between the flap bracket 12 and the door outer skin 2 are shown, in the upper areas 25 and 26. The elastic return action of the spring secures that the flap bracket stops 25 and 26 are in full contact with the door metal sheet, which ensures a very good surface level match, enabling thus to have a perfect control of the lining up of the surfaces between flap and door outer skin.

The drawing FIG. 13 shows the mechanical arrangement in the folded active position. The actuator is fully retracted and its action makes the flap rotate along the A1 axis to the completely folded position, in contact with full stop in the area 19.

Figure 14:
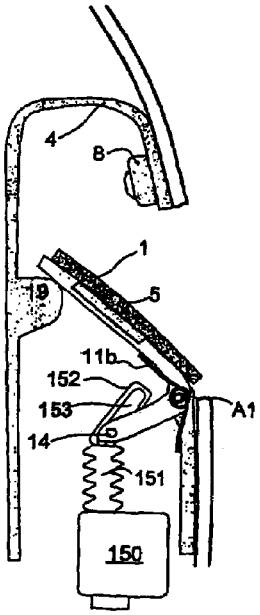

The drawing FIG. 14 shows the mechanical arrangement in the case of an external action pushing the flap, without any folding control. In this case, the hollow shape 153 which is located inside the connecting rod 152 allows the flap to rotate without moving the position of the actuator.

The articulation 14 is moving inside the connecting rod 152, the connecting rod rotates around the articulation 154, but the translation rod 151 does not move. Consequently, when the external action stops, the flap returns to the rest position thanks to the spring action, the connecting rod goes back to its original rest position and the actuator itself is not involved.

Figure 15:
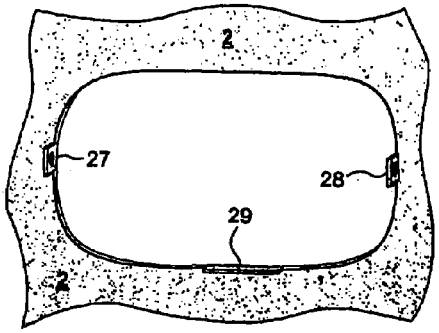

The drawing FIG. 15 shows a 3D view of the door outer skin, viewed from the door inside part. The elements 27, 28 and 29 are put in shape together with the stamping of the door outer skin, said elements being shaped at right angle with respect to the door surface. These 3 elements 27, 28 and 29 constitute the locating and fastening means of the handle housing 4 inside the vehicle door panel. Each of them includes a hole intended to receive a fastening means.

Figure 16:
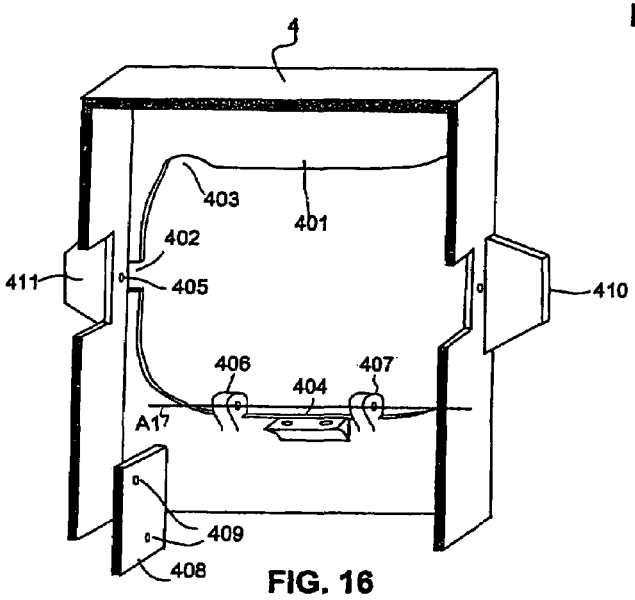

The drawing FIG. 16 shows a 3D view of the handle housing 4 which supports the main components of the system.

The area 401 is designed to support the door opening control switch 8 and its fastening. The area 402 interacts with the element 27 of the door outer skin and ensures the good locating of the housing with respect to the door outer panel and the housing fastening. The hole 405 is intended to receive the fastening means respective to the element 27.

The area 403 allows the upper part of the flap bracket 12 to interact directly with the door outer skin, in order to perform a perfect flush surfaces positioning between flap and door outer skin, viewed from the outside of the vehicle.

The area 404 is designed to support the housing with respect to the area 29 of the door outer skin.

The areas 406 and 407 are the hinges supporting the axle located in the axis A1.

The area 408 of the housing and the holes 409 are designed to support the locating and fastening of the actuator 150.

The areas 410 and 411 are side strengthening areas, and are designed to withstand the forces required to open the door after an accident, by the use of a rescue team hook device, in order to remove vehicle occupants.

The shape of the housing must match the door outer skin shape, and must fit in the available room taking into account the various elements necessary in the door.

According to another characteristic of the invention, the bottom part of the housing is opened so to ensure fluid draining, as water or other fluids may enter into the housing.

Figure 17:
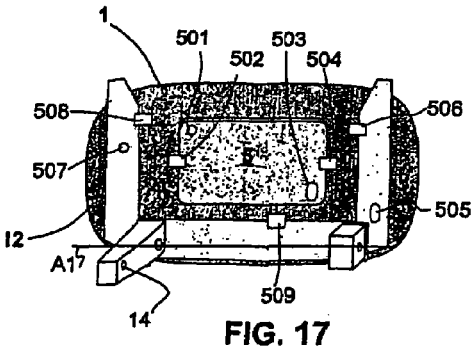

The drawing FIG. 17 shows a 3D view including the flap 1, its supporting bracket 12 and the sensor 5, together with all the clips and clamps used for the fastening of these elements.

The locating holes 501 and 503 are designed to secure the good positioning of the sensor on the flap. The elastic clips 502 and 504 are used to fasten the sensor in this position.

The locating holes 505 and 507 are designed to secure the good positioning of the flap 1 on the bracket 12. The elastic clips 506,508 and 509 are used to fasten the flap in this position on the bracket.

Another feature of the invention is to allow the location and the fastening of the user identifier authentication antenna, for example around the sensor.

BENEFITS OF THE INVENTION

Thanks to the invention, a completely new range of possibilities is offered to automotive style, due to the fact that the handle can be perfectly merged, integrated and hidden within the vehicle body.

Thanks to the invention, the aerodynamic drag is smaller than with conventional handle, thus resulting in a reduction of fuel consumption.

Thanks to the invention, the inner part of the handle is protected against dirt while the vehicle is submitted to adverse environmental conditions, thus preventing the fingers of the user to get dirty, while opening the door.

LIST OF MAIN COMPONENTS

1 Retractable flap (body match colored)
2 Door outer skin
3 User's hand
4 Handle and flap support module
5 Hand presence sensor
6 Control unit
7 Flap folding control motor
8 Electrical opening control, electrical latch version
9*e* Door locking/unlocking latch, electrical version
9*m* Door locking/unlocking latch, mechanical version
10 Flap traction cable
11*a* Flap return spring
11*b* Flap return spring
12 Flap bracket for folding
14 Fastening point for the folding traction
15 Fastening point for the return spring
16 Cable guidance
17 Cable elongation when flap is pushed by hand
18 Pulley/groove for cable winding
19 Flap full range stop
30 Outer face of fingers
31 Inner face of finger tip
40.Rocking lever for door latch control (mechanical version)
52 Sensor detection area
56 Sensor <-> Control unit link
60 Control unit <-> Communication antennas link
61 Communication antenna device
76 Control unit <-> Folding motor link
86 Control unit <-> Opening control link
96 Control unit <-> Door latch link

The invention claimed is:

1. An automobile door handle system, for a side door, a rear door or a trunk of the automobile, the system comprising:

a retractable flap configured to enclose a door handle housing;

a sensor configured to detect the presence of a hand or a finger when the hand or the finger is in proximity to the retractable flap, the sensor being positioned near the retractable flap, wherein the retractable flap retracts automatically inside the housing when the sensor detects the presence of the hand or the finger.

2. The automobile door handle system of claim 1, wherein the sensor is a capacitive sensor, and the sensor is completely hidden behind the retractable flap.

3. The automobile door handle system according to claim 1, further comprising:

a folding means configured to perform a manual folding action on the retractable flap, and a spring return system configured to allow the retractable flap to return to a closed position.

4. The automobile door handle system according to claim 1, further comprising an electrical door control having no direct mechanical link to a door latch, the electrical door control configured to operate the door latch.

5. The automobile door handle system according to claim 1, further comprising a mechanical door control having a direct mechanical link from the handle to a door latch, the mechanical door control configured to operate the door latch.

6. The automobile door handle system according to claim 1, wherein the retractable flap matches the outer form of the automobile body when the retractable flap is in a closed position.

7. The automobile door handle system according to claim 1, wherein the retractable flap is configured to rotate along a longitudinal axis located near a bottom part of the retractable flap.

8. The automobile door handle system according to claim 1, wherein the retractable flap is configured to be in a closed position when not being used to protect a handle control from the environment.

9. A control process of the automobile door handle system according to claim 1, the process comprising:

constantly monitoring the sensor output, retracting the retractable flap to give access to the door opening control when the sensor indicates a presence of a finger or a hand and door unlatching authorization is present or obtained.

10. The control process according to claim 9, the process further comprising returning the retractable flap to a rest position if the sensor fails to detect the presence of a hand or finger for a period of several hundred milliseconds.

* * * * *